US005611109A

United States Patent [19]

Wörwag

[11] Patent Number: 5,611,109

[45] Date of Patent: Mar. 18, 1997

[54] CLEANING ROLLER FOR THE SUCTION HEAD OF A VACUUM CLEANING DEVICE

[75] Inventor: Peter Wörwag, Romanshorn, Switzerland

[73] Assignee: Firma Fedag, Romanshorn, Switzerland

[21] Appl. No.: 603,431

[22] Filed: Feb. 20, 1996

[30] Foreign Application Priority Data

Feb. 20, 1995 [DE] Germany ..... 195 05 787

[51] Int. Cl.[6] ..... A47L 5/10

[52] U.S. Cl. ..... 15/386; 15/97.1; 15/401

[58] Field of Search ..... 15/386, 97.1, 383, 15/387, 401

[56] References Cited

U.S. PATENT DOCUMENTS

| | | | |
|---|---|---|---|
| 1,614,708 | 1/1927 | Bartling | 15/97.1 |
| 2,734,211 | 2/1956 | Vance . | |
| 2,993,224 | 7/1961 | Child | 15/387 |
| 2,994,098 | 8/1961 | Fukuba | 15/342 |
| 3,872,539 | 3/1975 | Doyel | 15/344 |
| 4,445,245 | 5/1984 | Lu | 15/383 X |
| 4,815,157 | 3/1989 | Tsuchiya | 15/342 X |
| 5,365,634 | 11/1994 | Hughes | 15/386 X |

FOREIGN PATENT DOCUMENTS 3933722 4/1990 Germany .

*Primary Examiner*—Chris K. Moore
*Attorney, Agent, or Firm*—Robert W. Becker & Associates

[57] ABSTRACT

A cleaning roller for a suction head has a substantially cylindrical base body with a cylindrical mantle surface. The base body is driven in rotation about an axis of rotation. Support members are connected to the base body and project radially past the cylindrical mantle surface. At least one elongate wiper blade with a shaft is fastened to the support members so as to extend parallel to the axis of rotation. The at least one wiper blade in its working position projects from the base body in the radial direction. The wiper blade is pivotable out of the working position about a pivot axis defined by the shaft. The wiper blade is made of elastic material.

20 Claims, 2 Drawing Sheets

CLEANING ROLLER FOR THE SUCTION HEAD OF A VACUUM CLEANING DEVICE

BACKGROUND OF THE INVENTION

The present invention relates to a cleaning roller, especially for a suction head or suction nozzle, comprised of a substantially cylindrical base body that is rotatably driven by a drive unit about an axis of rotation and that comprises at least one radially extending wiper blade in the longitudinal direction of the base body which is made of elastic material.

Such a cleaning roller is known from German Patent Application 39 33 722. The wiper blade, which extend in the longitudinal direction of the base body and projects substantially radially, extends helically over a circumferential angle of 180°. The wiper blade is comprised of an elastic material, i.e., rubber, in order to ensure that upon encountering a larger obstacle it can yield in a direction counter to the direction of rotation. The energy for deformation required for such a deflection must be provided by the drive motor. For an electromotorical drive unit there is usually a sufficient power available so that the cleaning roller will not come to a standstill. However, in the case of an air turbine being used as a drive motor and driven by the suction air stream only a limited amount of drive power is available. This amount of drive power is only slightly greater than the required deformation energy for deformation of the wiper blade. In practice this results in a standstill of the cleaning roller so that the cleaning process is impeded. The operator who guides the suction head thus must constantly check during operation of the device whether the cleaning roller is still rotating properly.

U.S. Pat. No. 2,734,211 discloses a cleaning roller which has a helical brush arrangement alternating with a cleaning strip. The cleaning strip has a reduced axial extension in comparison to the brush arrangement and will thus only impact on greater obstacles. The beater bar is comprised of an elastically deformable hollow body which upon impacting on an obstacle will yield due to local elastic deformation.

It is therefore an object of the present invention to provide a cleaning roller of the aforementioned kind with which for a high cleaning power a standstill of the cleaning roller upon impacting on a rigid obstacle can be securely prevented.

SUMMARY OF THE INVENTION

A cleaning roller for a suction head according to the present invention is primarily characterized by:

- A substantially cylindrical base body with a cylindrical mantle surface, the base body driven in rotation about an axis of rotation;
- Support members connected to the base body and projecting radially past the cylindrical mantle surface;
- At least one elongate wiper blade comprising a shaft, the at least one wiper blade fastened with the shaft to the support members so as to extend parallel to the axis of rotation;
- The at least one wiper blade in a working position projecting from the base body in the radial direction;
- The at least one wiper blade pivotable about a pivot axis defined by the shaft out of the working position; and
- The at least one wiper blade comprised of an elastic material.

Preferably, the shaft is a metal wire which is preferably elastic.

The shaft may be rotatably supported.

The support members in a preferred embodiment of the present invention are ring flanges.

Advantageously, the at least one wiper blade has a height and in the working position the at least one wiper blade projects past the support members with more than half its height.

Preferably, in a circumferential direction of the base body a plurality of wiper blades are arranged.

The wiper blades are preferably positioned diametrically opposite one another.

In yet another embodiment of the present invention the at least one wiper blade is shorter than the length of the base body.

A plurality of wiper blades is preferably arranged such that over the length of the base body more than one of the wiper blades are positioned.

Advantageously, the wiper blades have identical length.

In another embodiment of the present invention the base body is comprised of a first section and a second section and each one of the sections has some of the wiper blades arranged thereat. The wiper blades of the first section are preferably staggered in the circumferential direction of the base body relative to the wiper blades of the second section.

Preferably, the wiper blades of the first section are staggered by 90° relative to the wiper blades of the second section.

The at least one wiper blade in cross-section is preferably symmetrical to the radial plane of the base body.

The pivot axis is positioned in the radial plane.

Advantageously, the at least one wiper blade is comprised of plastic material or rubber.

In another preferred embodiment of the present invention the base body is comprised of plastic material. Preferably, the support members are also comprised of plastic material.

Advantageously, the base body and the support members are a unitary part.

The wiper blade which extends substantially straight and parallel to the axis of rotation of the base body is pivoted upon impacting on an obstacle from its substantially radially extending working position about the pivot axis so that a shortening of the effective radial height of the wiper blade is effected. The pivoting action of the wiper blade is carried out against force components of the centrifugal force which, due to the rotational movement of the base body, will try to position the wiper blade in its radially extending working position. A deformation of the wiper blade is thus substantially not necessary. The force required for pivoting the wiper blade is smaller by a multitude than the force required for a limited deformation of the wiper blade.

Preferably, the pivot axis is in the form of a shaft, especially in the form of a metal wire, preferably an elastically deformable metal wire. The shaft is then supported within support members which project past the diameter (defining the cylindrical mantle surface) of the base body and is preferably rotatably supported so that only at the ends of the shaft within the bearing openings of the support members friction will occur. This design reduces the frictional force to be overcome upon rotation to a minimum.

Preferably, over the circumference of the base body a plurality of wiper blades is arranged which are positioned diametrically opposite one another. This arrangement ensures an evenly weighted (balanced) cleaning roller whereby preferably the number of wiper blades is a multiple of the number 2.

The wiper blades have especially a shorter length than the base body so that over the length of the base body a plurality of wiper blades are arranged in axial succession. They preferably have the same length. This allows for a design in which the wiper blades arranged within one section of the base body are staggered relative to the wiper blades positioned at the neighboring second section of the base body. When the cleaning roller impacts on an obstacle extending over the lengths of the cleaning roller, then only one of the wiper blades distributed over the length of the base body will come into contact with the obstacle. For pivoting this wiper blade only minimal forces are necessary so that an excessive reduction of rpm of the base body will not occur. This ensures that after surmounting the obstacle a sufficiently great centrifugal force is available in order to return the wiper blade as soon as possible into its radially extending working position.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3.

Figure 1:
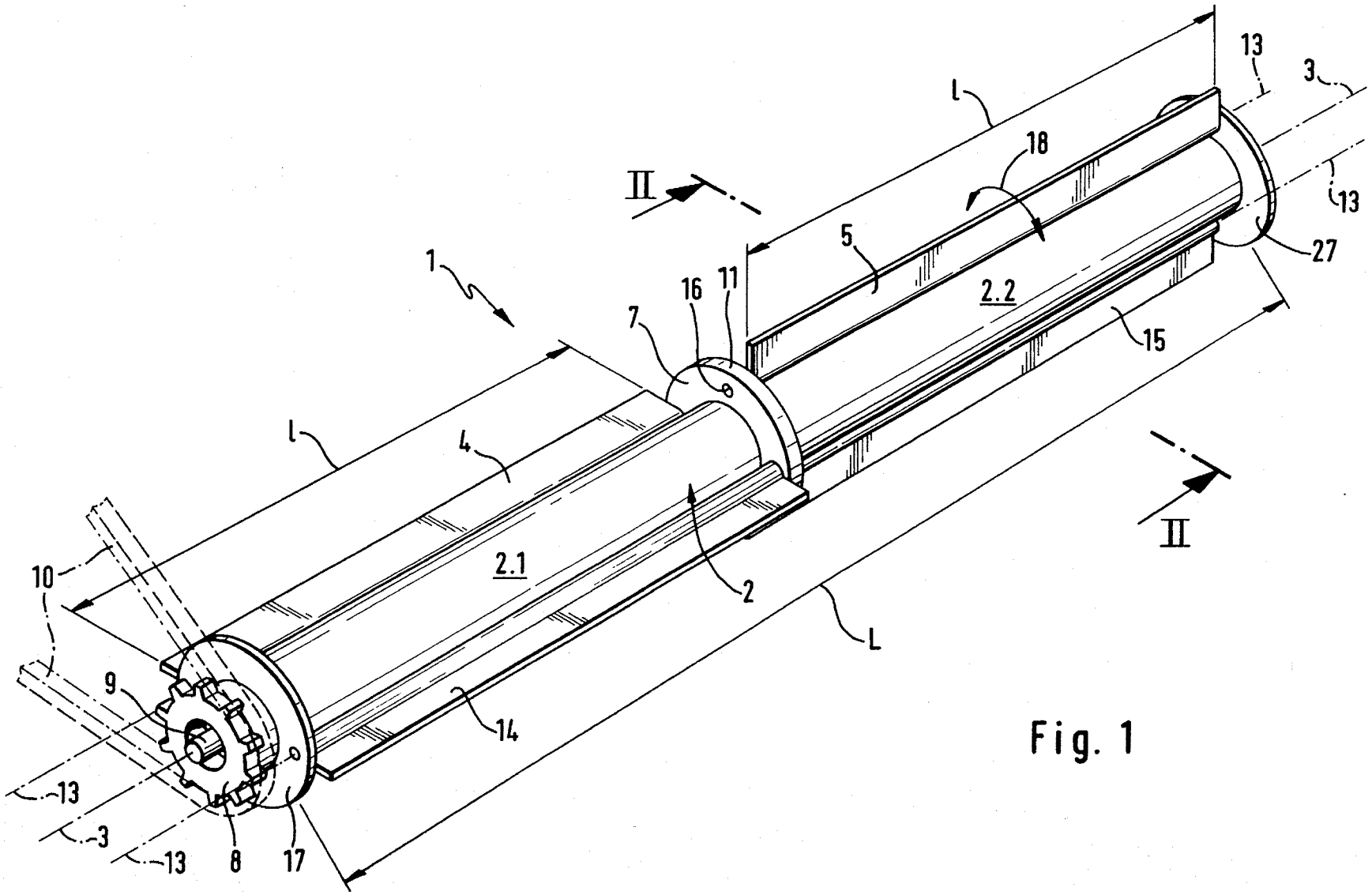
FIG. 1 is a perspective view of the inventive cleaning roller with wiper blades.

The cleaning roller 1 represented in FIG. 1 is comprised of a base body 2 which can be rotated about axis of rotation 3. The base body 2 can be a hollow tubular body (this is indicated in dashed-lines in FIG. 2) and is provided at its ends with bearing pins 9 which engage corresponding bearing eyes in the housing of a suction head. At one end of the base body 2 a drive wheel 8 is provided that in the shown embodiment is in the form of a gear wheel. On it a drive belt 10 is positioned which is driven by a drive motor for rotating the base body 2 about the axis of rotation 3. The drive motor may be an electric motor. However, it is advantageous to employ an air turbine that is driven by a suction stream entering the suction head.

In the shown embodiment the base body 2 is comprised of two sections 2.1 and 2.2 preferably having the same outer diameter D (FIG. 2) which sections are fixedly connected to one another. The sections 2.1 and 2.2 are separated by an annular flange 7. At the free ends of the sections 2.1 and 2.2 ring flanges 17 and 27 (disks) are arranged in the same manner. The bearing pin 9 and the drive wheel 8 are connected to the ring flange 17 at its end face which is facing away from the base body. The ring flanges 7, 17 and 27 have preferably the same outer diameter R. The exterior ring flanges 17 and 27 are expediently narrower than the inner ring flange 7.

The base body 2, respectively, its sections 2.1 and 2.2 as well as the support members 7, 17, and 27 are comprised of plastic. Especially the base body and the support members are formed as a unitary part, for example, by injection molding.

Over the circumference of the base body 2, respectively, one of its sections 2.1 or 2.2 wiper blades 4, 14, 5, 15 are arranged. These wiper blades 4, 5, 14, 15 extend substantially straight parallel to the axis of rotation 3 of the base body 2 whereby each wiper blade 4, 5, 14, 15 can be pivoted about an axis 13 that is parallel to the axis of rotation 3 of the base body 2. Each wiper blade projects in its radial working position (FIG. 2) relative to the axis of rotation 3 past the outer edge 11 of the ring flanges 7, 17, 27 by more than half its height H. The diameter R of the ring flanges 7, 17, 27 is approximately 15 to 40 mm.

Figure 2:
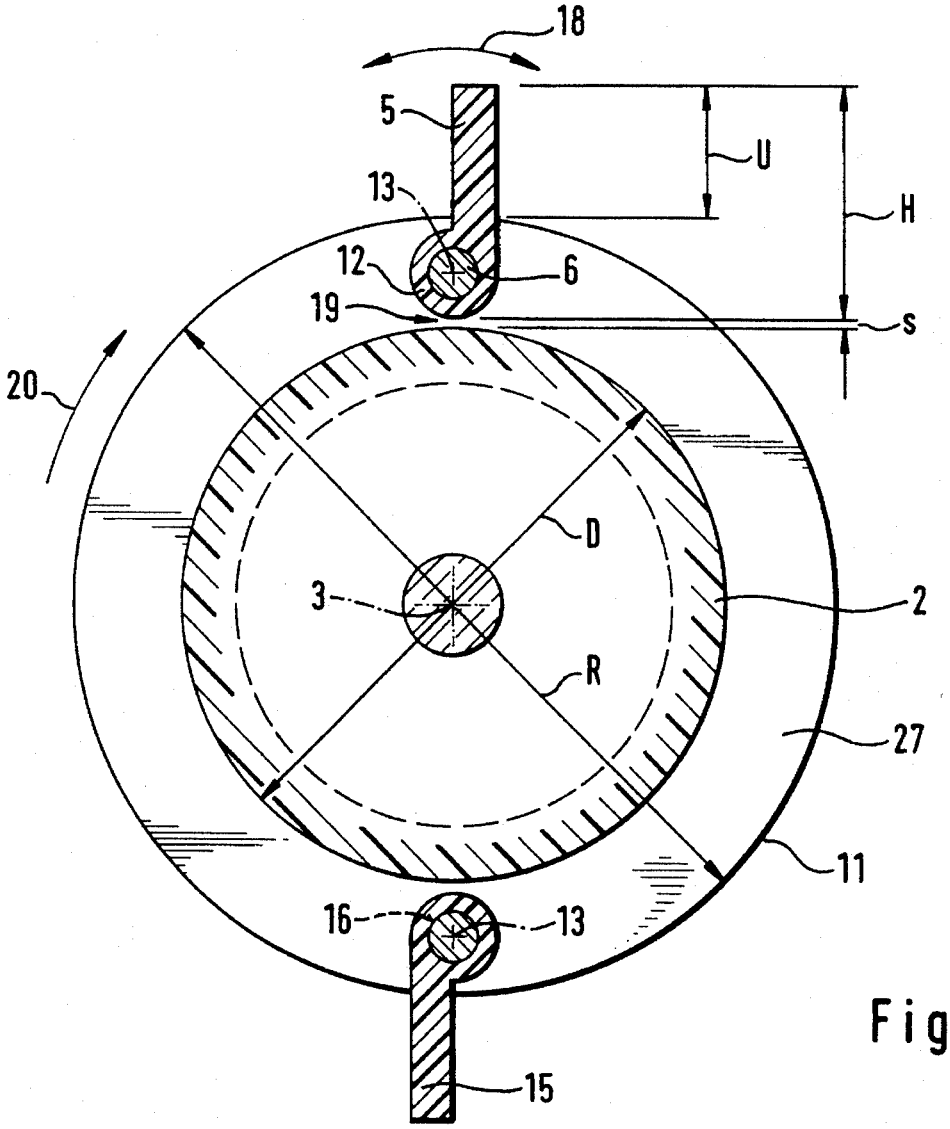
FIG. 2 is a section along the line II—II of FIG. 1.

As is shown in FIG. 2, the pivot axis 13 is formed by a shaft 6 which penetrates the foot portion 12 of a wiper blade facing the base body 2. The shaft 6 is positioned between two neighboring ring flanges 7 and 17, respectively, 7 and 27 and projects with its ends into a respective bearing eye 16 of the ring flanges 7, 17, 27. Each wiper blade is thus pivotable in the direction of double arrow 18 of FIG. 2 about the axis of rotation 13 whereby with increasing pivot angle the portion U projecting past the edge 11 of the ring flanges 7, 17, 27 is reduced.

A wiper blade 4, 5, 14, 15 is comprised expediently of an injection-moldable material such as plastic. Preferably, the wiper blade is made of an elastic material such as elastic plastic or rubber. This embodiment is especially expedient with respect to impacting of the wiper blade on small obstacles. Preferably, the wiper blade 4, 5, 14, 15 is injection molded onto the shaft 6, respectively, vulcanized thereto and forms therewith a unitary component.

A wiper blade 4, 5, 14, 15 in cross-section may have the shape of FIG. 6 (FIG. 2). The shaft 6 is arranged with the foot of the FIG. 6 adjacent to the base body. The foot 12 of the wiper blade 5 is positioned at a distance S to the circumferential surface of the base body 2. The thus formed gap 19 ensures the pivotability of the wiper blade 5. The distance S is preferably selected such that a jamming of dirt within the slot 19 can be substantially prevented. Preferably, the wiper blade is embodied symmetrically to a radial plane E, as shown in FIG. 3. The pivot axis 13 is positioned expediently within the symmetry plane E. This has the advantage that the center of gravity of this wiper blade 5 is positioned within the plane E so that, independent of the rotational direction 20, the wiper blade 5 will assume the same radially-extending working position relative to the axis of rotation 3, as shown in FIG. 2.

Figure 3:
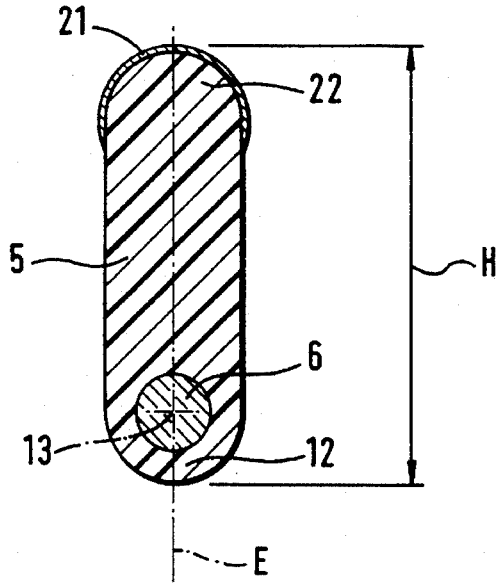
FIG. 3 shows a section of the wiper blade.

It may be expedient to embody the head 22 which is remote from the foot 12 of the wiper blade with a rounded, respectively, partly rounded end according to the representation of FIG. 3. In order to reduce the wear of a wiper blade 5, a layer of wear-resistant material 21 is applied in the area of the head 22.

The shaft 6 which defines the pivot axis 13 is comprised of a metal wire, especially an elastic metal wire such as steel wire etc. For the purpose of mounting, the metal wire or the metal bracket can be elastically deformed in order to thread the ends of the shaft 6 into the bearing eyes 16 of the support member in the form of ring flanges 7, 17, 27.

In the shown embodiment, one pair of wiper blades 4, 14, respectively 5, 15 is arranged on each section 2.1, respectively, 2.2 of the base body 2. The wiper blades 4, 14, respectively, 5, 15 of one pair are positioned preferably diametrically opposite one another so that the base body with respect to its axis of rotation 3 is properly balanced. It is especially preferred that the wiper blades 4, 14 of the first section 2.1 of the base body 2 are staggered relative to the wiper blades 5, 15 of the second adjacent section 2.2 of the base body 2. The wiper blades 4, 14 arranged within the section 2.1 of the base body 2 are staggered in a circumferential direction by an angular distance of approximately 90° relative to the neighboring section 2.2 of the base body 2 with wiper blades 5 and 15. In the axial direction of the base body 2 there are thus two axially sequentially arranged wiper blades 4, 5, respectively, 14, 15.

In the shown embodiment, each wiper blade 4, 14, 5, 15 has a length I which is shorter than the length L of the base body 2. Preferably, the lengths I of all wiper blades 4, 5, 14, 15 are identical whereby the length I is shorter than half the length L/2 of the base 2. The shortened length is dependent on the thickness of the support members (ring flanges) 7, 17, 27. Especially the thickness of the central ring flange 7 is important in this respect. In the central ring flange 7 four bearing eyes 16 are arranged which in the circumferential direction are positioned relative to one another at an angular distance of 90°, respectively. The outer ring flanges 17, 27 are provided with two diametrically arranged bearing eyes 16.

In the circumferential direction of the base body 2 it is possible to arrange only wiper blades whereby the number thereof is preferably a multiple of the number 2. Expediently, the circumference of the base body may also be provided with brushes etc. in combination with one or more wiper blades, as is essentially known in similar embodiment for brush rollers of vacuum cleaning devices.

The present invention is, of course, in no way restricted to the specific disclosure of the specification and drawings, but also encompasses any modifications within the scope of the appended claims.

What I claim is:

1. A cleaning roller for a suction head, said cleaning roller comprising:

a substantially cylindrical base body with a cylindrical mantle surface, said base body driven in rotation about an axis of rotation;

support members connected to said base body and projecting radially past said cylindrical mantle surface;

at least one elongate wiper blade comprising a shaft, said at least one wiper blade fastened with said shaft to said support members so as to extend parallel to said axis of rotation;

said at least one wiper blade in a working position projecting from said base body in the radial direction;

said at least one wiper blade pivotable about a pivot axis defined by said shaft out of said working position; and said at least one wiper blade comprised of an elastic material.

2. A cleaning roller according to claim 1, wherein said shaft is a metal wire.

3. A cleaning roller according to claim 2, wherein said metal wire is elastic.

4. A cleaning roller according to claim 1, wherein said shaft is rotatably supported.

5. A cleaning roller according to claim 1, wherein said support members are ring flanges.

6. A cleaning roller according to claim 1, wherein said at least one wiper blade has a height and wherein in said working position said at least one wiper blade projects past said support members with more than half said height.

7. A cleaning roller according to claim 1, wherein in a circumferential direction of said base body a plurality of said wiper blades are arranged.

8. A cleaning roller according to claim 7, wherein said wiper blades are positioned diametrically opposite one another.

9. A cleaning roller according to claim 1, wherein said at least one wiper blade is shorter than a length of said base body.

10. A cleaning roller according to claim 9, wherein a plurality of said wiper blades are arranged such that over said length of said base body more than one of said wiper blades are positioned.

11. A cleaning roller according to claim 10, wherein said wiper blades have an identical length.

12. A cleaning roller according to claim 10, wherein:

said base body is comprised of a first section and a second section;

each one of said sections has some of said wiper blades arranged thereat;

said wiper blades of said first section staggered in the circumferential direction of said base body relative to said wiper blades of said second section.

13. A cleaning roller according to claim 12, wherein said wiper blades of said first section are staggered by 90° relative to said wiper blades of said second section.

14. A cleaning roller according to claim 1, wherein said at least one wiper blade cross-section is symmetrical to a radial plane of said base body.

15. A cleaning roller according to claim 14, wherein said pivot axis is positioned in said radial plane.

16. A cleaning roller according to claim 1, wherein said at least one wiper blade is comprised of plastic material.

17. A cleaning roller according to claim 1, wherein said at least one wiper blade is comprised of rubber.

18. A cleaning roller according to claim 1, wherein said base body is comprised of plastic material.

19. A cleaning roller according to claim 1, wherein said support members are comprised of plastic material.

20. A cleaning roller according to claim 1, wherein said base body and said support members are a unitary part.

* * * * *